US010714253B2

(12) United States Patent
Kwon et al.

(10) Patent No.: US 10,714,253 B2
(45) Date of Patent: Jul. 14, 2020

(54) COIL COMPONENT

(71) Applicant: SAMSUNG ELECTRO-MECHANICS CO., LTD., Suwon-si, Gyeonggi-do (KR)

(72) Inventors: Sang Kyun Kwon, Suwon-si (KR); Jong Ho Chung, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 41 days.

(21) Appl. No.: 15/719,286

(22) Filed: Sep. 28, 2017

(65) Prior Publication Data

US 2018/0268983 A1 Sep. 20, 2018

(30) Foreign Application Priority Data

Mar. 14, 2017 (KR) ..... 10-2017-0031998

(51) Int. Cl.

| | |
|---|---|
| ***H01F 3/08*** | (2006.01) |
| ***H01F 27/255*** | (2006.01) |
| ***H01F 27/29*** | (2006.01) |
| ***H01F 3/10*** | (2006.01) |
| *H01F 1/153* | (2006.01) |

(52) U.S. Cl.

CPC ..... *H01F 27/255* (2013.01); *H01F 3/10* (2013.01); *H01F 27/292* (2013.01); *H01F 1/153* (2013.01); *H01F 1/15375* (2013.01); *H01F 2003/106* (2013.01)

(58) Field of Classification Search

CPC ..... H01F 1/153; H01F 27/255; H01F 27/292; H01F 3/10; H01F 3/08; H01F 2003/106

USPC ..... 336/200, 233, 192; 252/62.55; 977/778, 977/810, 838; 428/693.1, 570, 701, 403

See application file for complete search history.

(56) References Cited

U.S. PATENT DOCUMENTS

| | | | | |
|---|---|---|---|---|
| 2002/0097124 | A1* | 7/2002 | Inoue | H01F 1/24 336/83 |
| 2006/0119461 | A1* | 6/2006 | Kawarai | H01F 17/043 336/200 |
| 2011/0227690 | A1* | 9/2011 | Watanabe | C22C 38/00 336/221 |
| 2011/0285486 | A1* | 11/2011 | Maeda | B22F 1/0062 335/297 |
| 2013/0113593 | A1* | 5/2013 | Jeong | H01F 17/0013 336/200 |
| 2013/0228717 | A1* | 9/2013 | Harada | H01F 1/26 252/62.55 |

* cited by examiner

*Primary Examiner* — Mang Tin Bik Lian

(74) *Attorney, Agent, or Firm* — Morgan, Lewis & Bockius LLP

(57) ABSTRACT

A coil component includes a body having a coil part embedded therein, and an external electrode connected to the coil part. The body contains a plurality of first magnetic particles and a plurality of second magnetic particles, the second magnetic particles being smaller than the first magnetic particles, and the pluralities of first and second magnetic particles are dispersed in a main insulating portion. The plurality of second magnetic particles are dispersed in each of a plurality of sub-insulating portions to constitute composites, and a volume percentage of the second magnetic particles in the composites is 80% to 90%.

16 Claims, 4 Drawing Sheets

I-I'

A

COIL COMPONENT

CROSS-REFERENCE TO RELATED APPLICATION(S)

This application claims the benefit of priority to Korean Patent Application No. 10-2017-0031998 filed on Mar. 14, 2017 in the Korean Intellectual Property Office, the disclosure of which is incorporated herein by reference in its entirety.

BACKGROUND

1. Field

The present disclosure relates to a coil component.

2. Description of Related Art

In accordance with the miniaturization and thinning of electronic devices such as digital televisions (TV), mobile phones, laptop computers, and the like, miniaturization and thinning of coil components used in these electronic devices have been demanded. In order to satisfy such demand, research into and the development of various winding-type or thin-film type coil components have been actively conducted.

A main issue relating to the miniaturization and thinning of the coil component is to implement characteristics equal to the characteristics of an existing coil component in spite of the miniaturization and thinning. In order to satisfy such demand, a ratio of a magnetic material should be increased in a core in which the magnetic material is filled. However, there is a limitation in increasing the ratio due to the strength of a body of an inductor, a change in frequency characteristics depending on insulating properties, and the like.

As an example of a method of manufacturing the coil component, a method of implementing the body by stacking and then pressing sheets in which magnetic particles, a resin, and the like, are mixed with each other on coils has been used. In this case, it is advantageous in terms of magnetic permeability characteristics, or the like, of the coil component, to increase a content of the magnetic particles. To this end, coil components using fine magnetic particles have been manufactured. However, in this case, a specific surface area of the magnetic particles is increased, such that a content of the resin also needs to be increased. Therefore, a content of the magnetic particles is reduced.

SUMMARY

An aspect of the present disclosure may provide a coil component in which a content of an insulating portion in which fine magnetic particles are dispersed may be significantly reduced in spite of using the fine magnetic particles and magnetic permeability and direct current (DC) bias characteristics may be improved.

According to an aspect of the present disclosure, a coil component may include a body having a coil part embedded therein; and an external electrode connected to the coil part. The body has a structure in which a plurality of first magnetic particles and a plurality of second magnetic particles, the second magnetic particles being smaller than the first magnetic particles, the pluralities of first and second magnetic particles being dispersed in a main insulating portion, and the plurality of second magnetic particles are dispersed in each of a plurality of sub-insulating portions to constitute composites, and a volume percentage of the second magnetic particles in the composites is 80% to 90%.

At least some of the plurality of second magnetic particles in the composites may be in contact with each other.

A plurality of composites may be provided, each of the plurality of composites may include the plurality of second magnetic particles, and shapes of at least some of the plurality of composites may be different from each other.

The shapes of the plurality of composites may have random form.

The numbers of second magnetic particles included in the plurality of composites may have random form.

Volume percentages of the second magnetic particles included in the plurality of composites may have random form.

An interval between the plurality of second magnetic particles belonging to the same composite, among the plurality of composites, may be smaller than that between the plurality of second magnetic particles belonging to different composites of the plurality of composites.

The composite may have an average diameter of 1 μm to 20 μm.

The first magnetic particle may have an average particle diameter of 5 μm to 20 μm.

The second magnetic particle may have an average particle diameter less than 5 μm.

At least some of the plurality of second magnetic particles may have different sizes.

Some of the plurality of second magnetic particles may have an average particle diameter less than 1 μm.

The main insulating portion may include a thermoplastic resin.

The sub-insulating portion may include a thermoplastic resin.

The sub-insulating portion may be formed of a material having a softening point of 50° C. or more.

The main insulating portion and the sub-insulating portion may be formed of different materials.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Electronic Device

Figure 1:
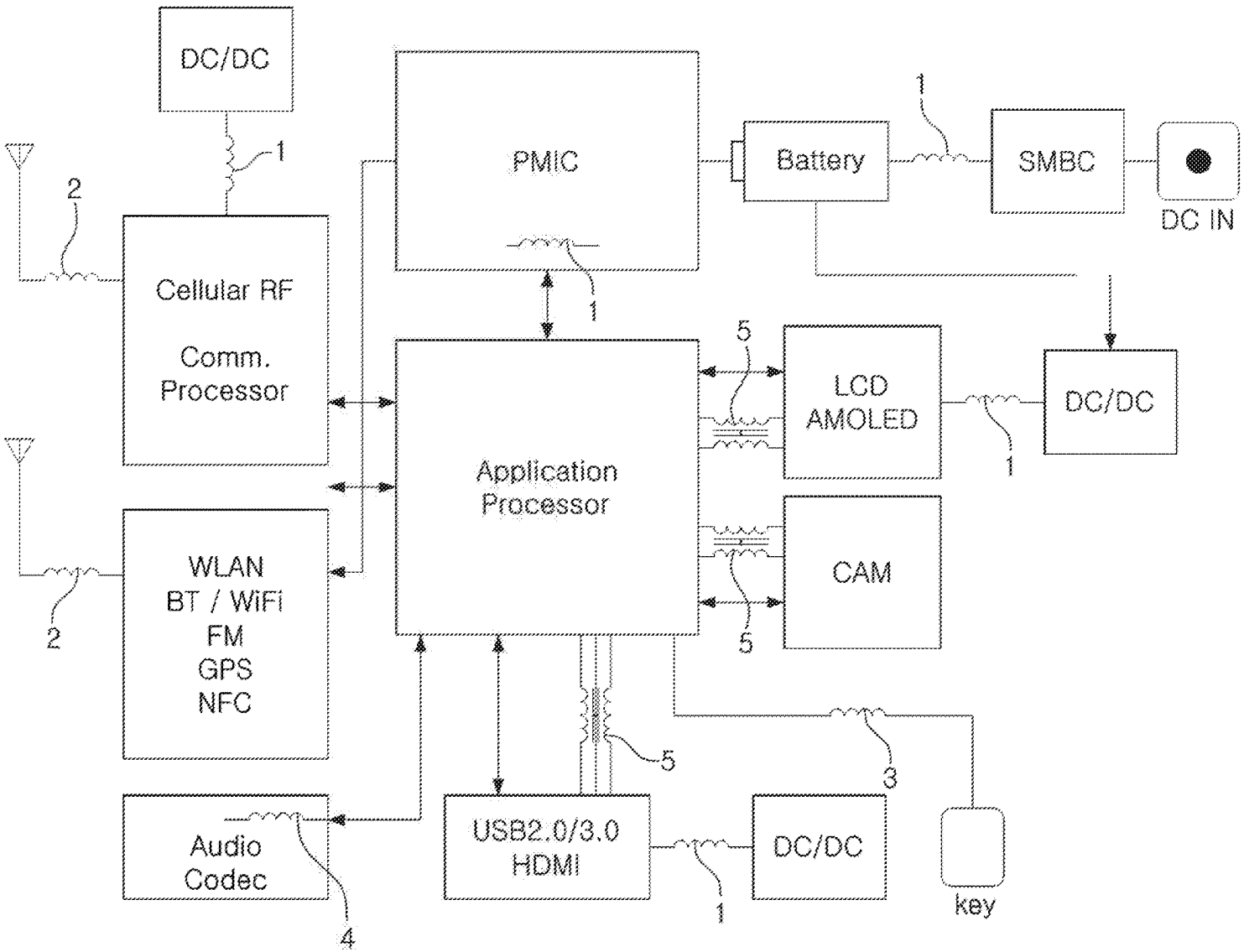
FIG. 1 is a schematic view illustrating an example of a coil component used in an electronic device.

FIG. 1 is a schematic view illustrating an example of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. Here, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smart phone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices well-known to those skilled in the art, in addition to the devices described above.

Coil Component

Hereinafter, a coil component according to the present disclosure, particularly, an inductor, will be described for convenience of explanation. However, the coil component according to the present disclosure may also be applied as a coil component for various other purposes, as described above.

Figure 2:
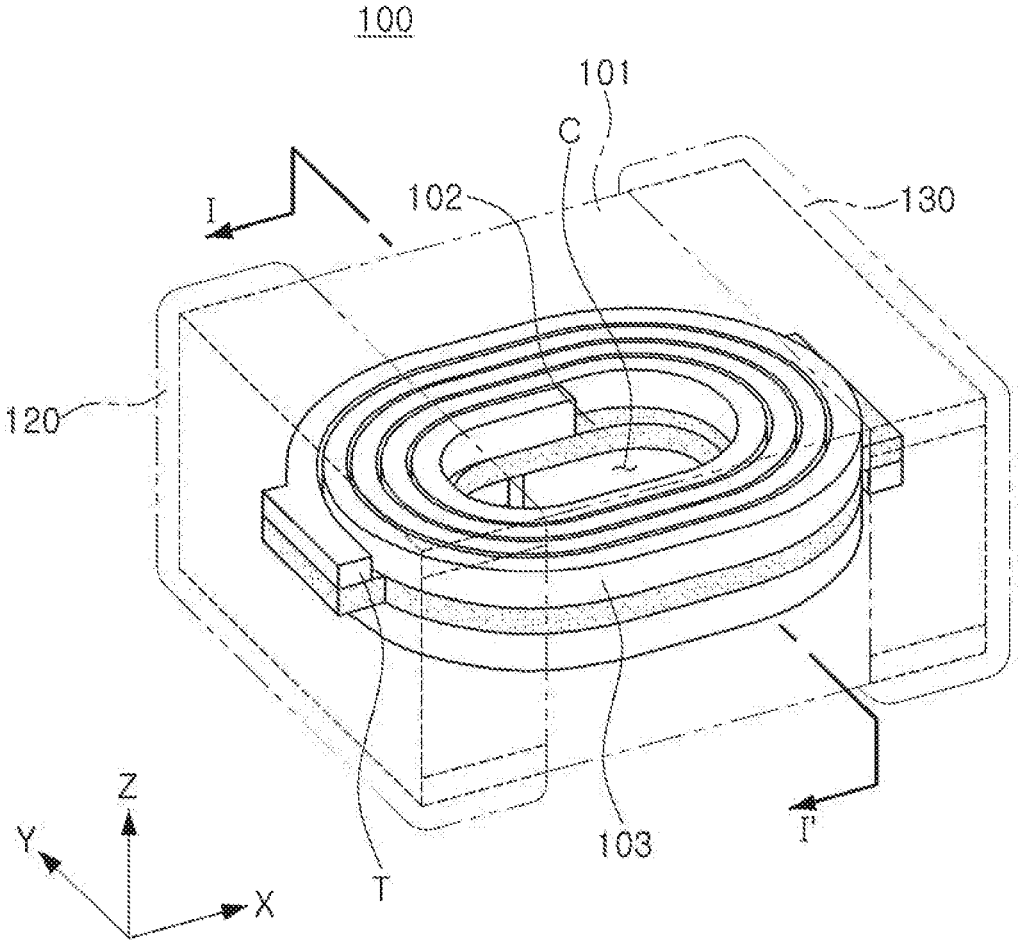
FIG. 2 is a schematic perspective view illustrating a coil component according to an exemplary embodiment in the present disclosure.
Figure 3:
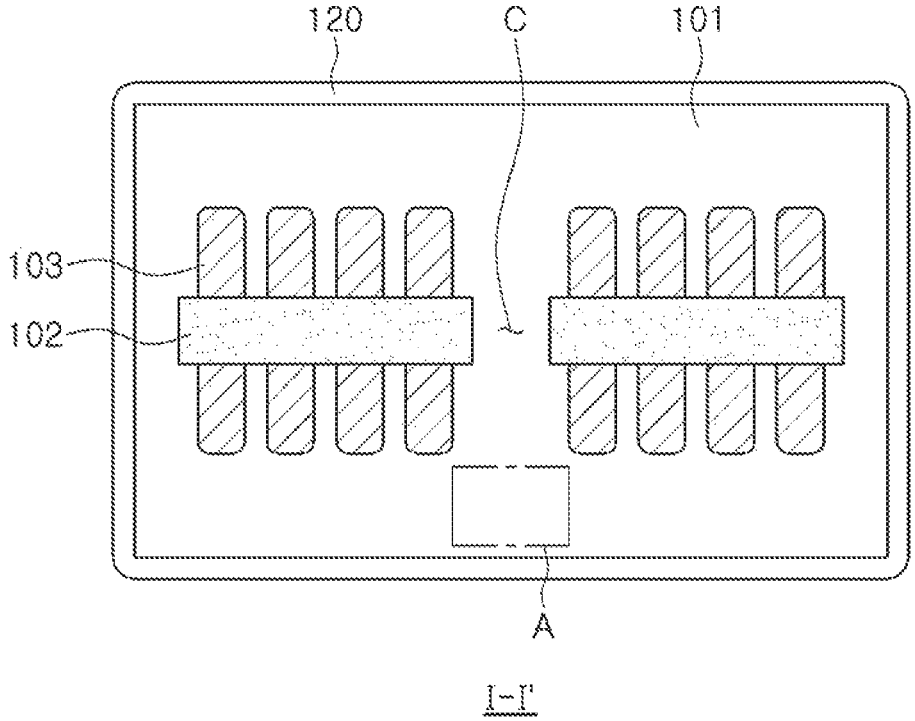
FIG. 3 is a schematic cross-sectional view of the coil component taken along line I-I' of FIG. 2.
Figure 4:
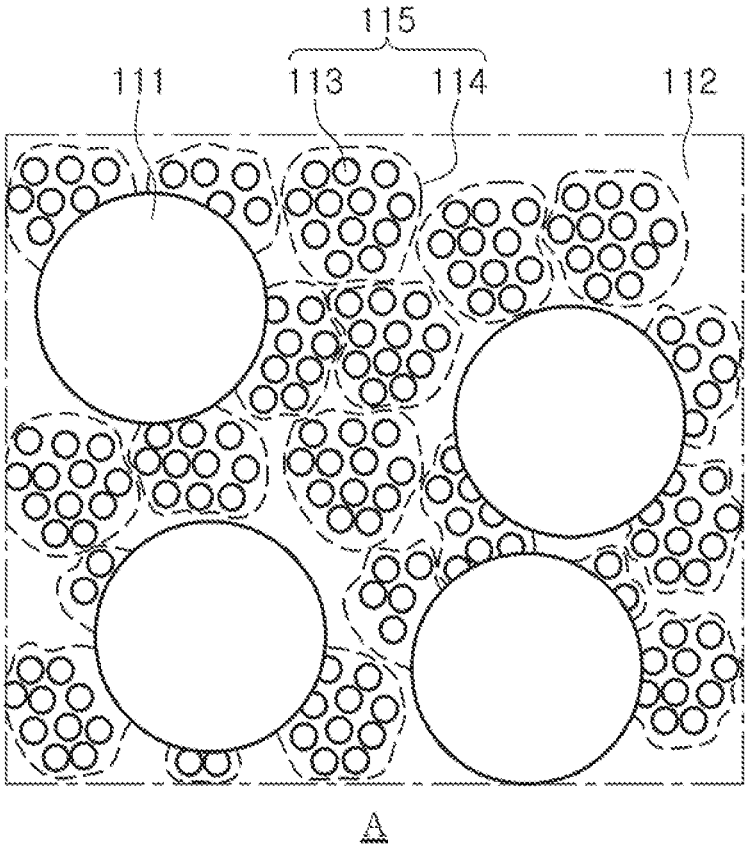
FIG. 4 is an enlarged view illustrating a body region in the coil component of FIG. 3.

FIG. 2 is a schematic perspective view illustrating a coil component according to an exemplary embodiment in the present disclosure. In addition, FIG. 3 is a cross-sectional view taken along line I-I' of FIG. 2. In this case, in the following description provided with reference to FIG. 2, a 'length' direction refers to an 'X' direction of FIG. 2, a 'width' direction refers to a 'Y' direction of FIG. 2, and a 'thickness' direction refers to a 'Z' direction of FIG. 2. FIG. 4 is an enlarged view illustrating a body region in the coil component of FIG. 3.

Referring to FIGS. 2 and 3, a coil component 100 according to an exemplary embodiment in the present disclosure may include a body 101 including a coil part 103 and a support member 102, and external electrodes 120 and 130.

The body 101 may include the coil part 103 and a magnetic material disposed in the vicinity of the coil part 103. As an example of such a magnetic material, there may be magnetic particles such as metal magnetic particles, or the like, provided in a resin. In this case, the metal magnetic particles may include one or more selected from the group consisting of iron (Fe), silicon (Si), chromium (Cr), boron (B), and nickel (Ni). For example, the metal magnetic particle may be an Fe—Si—B—Cr based amorphous metal, but is not necessarily limited thereto. As a more specific example, the metal magnetic particle may be formed of a nanocrystalline alloy of Fe—Si—B—Nb—Cr, an Fe—Ni based alloy, an Fe based alloy, or the like.

As described below, the body 101 may include magnetic particles having different sizes, and may have a form in which fine magnetic particles are dispersed at a high density in a sub-insulating portion. Due to such a structure, the fine magnetic particles may be uniformly dispersed in the body 101, and magnetic permeability and direct current (DC) bias characteristics of the coil component 100 may be improved.

The coil part 103 may perform various functions in the electronic device through a property provided by a coil of the coil component 100. For example, the coil component 100 may be a power inductor. In this case, the coil part 103 may serve to store electricity in magnetic field form to maintain an output voltage, thereby stabilizing power. In this case, coil patterns constituting the coil part 103 may be stacked on opposite surfaces of the support member 102, and may be electrically connected to each other through a conductive via penetrating through the support member 102. The coil part 103 may have a spiral shape, and include lead portions T formed at the outermost portions of the coil part having the spiral shape. The lead portions T may be exposed to the outside of the body 101 for the purpose of electrical connection to the external electrodes 120 and 130. The coil patterns constituting the coil part 103 may be formed in a plating process used in the related art, for example, a pattern plating process, an anisotropic plating process, an isotropic plating process, or the like, and may also be formed in a multilayer structure through a plurality of these processes.

The support member 102 supporting the coil part 103 may be formed of a polypropylene glycol (PPG) substrate, a ferrite substrate, a metal based soft magnetic substrate, or the like. In this case, a through-hole may be formed in a central region of the support member 102, and a magnetic material may be filled in the through-hole to form a core region C. The core region C may constitute a portion of the body 101. As described above, the core region C filled with the magnetic material may be formed to improve performance of the coil component 100.

The external electrodes 120 and 130 may be formed on the body 101 to be connected to the lead portions T, respectively. The external electrodes 120 and 130 may be formed of a paste including a metal having excellent electrical conductivity, for example, a conductive paste including nickel (Ni), copper (Cu), tin (Sn), or silver (Ag), or alloys thereof. In addition, plating layers (not illustrated) may be further formed on the external electrodes 120 and 130. In this case, the plating layers may include one or more selected from the group consisting of nickel (Ni), copper (Cu), and tin (Sn). For example, nickel (Ni) layers and tin (Sn) layers may be sequentially formed in the plating layers.

A detailed form of the body 101 will be described with reference to FIG. 4. In the present exemplary embodiment, the body 101 may have a structure in which a plurality of first magnetic particles 111 and a plurality of second magnetic particles 113 having a size smaller than that of the first magnetic particles 111 are dispersed in a main insulating portion 112. In this case, the plurality of second magnetic particles 113 may be dispersed in each of a plurality of sub-insulating portions 114 to constitute composites 115, and a volume percentage of the second magnetic particles 113 in the composites 115 may be 80% to 90%.

In the present exemplary embodiment, an average particle diameter of the first magnetic particle 111 may be within a range from 5 μm to 20 μm, and an average particle diameter of the second magnetic particle 113 may be less than 5 μm. The first and second magnetic particles 111 and 113 having different sizes may be mixed with each other, such that dispersion properties and densities of the magnetic particles 111 and 113 may be improved. In this case, at least some of the second magnetic particles 113 constituting the composites 115 and having a fine size may have different average particle diameters. In other words, some of the plurality of second magnetic particles 113 may have a finer size, for example, an average particle diameter less than 1 μm.

The composites 115 obtained by pressing the second magnetic particles 113, fine particles having a relatively small size, at a high pressure, in order to increase a density of the second magnetic particles 113, may be used. Therefore, even though a volume percentage of the second magnetic particles 113 is increased, a specific surface area of the second magnetic particles may not be significantly increased. In a case of such a high density structure, an interval between the plurality of second magnetic particles 113 in the composites 115 may be significantly reduced. In addition, as in a form illustrated in FIG. 4, at least some of the plurality of second magnetic particles 113 in the composites 115 may be in contact with each other. In addition, an interval between the second magnetic particles 113 belonging to the same composite 115 may be smaller than that between the second magnetic particles 113 belonging to different composites 115. Micropores may exist in the composites 115 having such a form. Therefore, even though shapes of the composites 115 are changed at the time of performing forming, deterioration of magnetic characteristics due to generation of stress may be suppressed.

As described above, the volume percentage of the second magnetic particles 113 in the composites 115 may be 80% to 90%, and such a high density structure may be obtained by a forming process of applying a maximum pressure in a range in which the sub-insulating portions 114 are not broken. In more detail, the second magnetic particles 113 may be first mixed with a material of the sub-insulating portion 114 to manufacture a slurry form. Such a slurry may be pressed and formed at a high pressure, be dried, and again pulverized to form the composites 115. In this case, an average diameter of the pulverized composite 115 may be 1 μm to 20 μm.

Each of a plurality of composites 115 obtained by such a process may include the plurality of second magnetic particles 113. In addition, since a pulverizing process is again performed after a drying process, shapes of appearances of at least some of the plurality of composites 115 may be different from each other, as in a form illustrated in FIG. 4, and the shapes of the plurality of composites 115 may have random form. In addition, a random form may also be applied to the numbers or volume percentages of second magnetic particles 113. In other words, the numbers of second magnetic particles 113 included in the plurality of composites 115 may have random form, and at the same time or separately, the volume percentages of the second magnetic particles 113 included in the plurality of composites 115 may have random form.

The composites 115 obtained as described above may be mixed with the first magnetic particles 111 to manufacture a slurry form dispersed in the main insulating portion 112, and the slurry form may be pressed and formed once again. A plurality of formed products may be manufactured, if necessary, and may be stacked and then formed to implement the body 101 described above.

As described above, since the composites 115 include the second magnetic particles 113 at a high volume percentage in a state in which the sub-insulating portions 114 of the composites 115 are not broken, the increase in the specific surface area of the second magnetic particles 113 may be significantly suppressed. Therefore, even though a content of the sub-insulating portions 114 is not increased, densities of the magnetic particles 111 and 113 in the body 101 may be increased. A material that may form agglomerates having a strong bond may be used in order to prevent the sub-insulating portions 114 from being broken in a pressing and forming process. In detail, a material of each of the sub-insulating portions 114 may be a thermosetting resin (phenolic resins or polyimide resins), a thermoplastic resin (chlorinated polyethylene (CPE), polypropylene (PP), ethylene propylene diene monomer (EPDM), or nitrile butadiene rubber (NBR)), a wax based material, an inorganic material (water glass, magnesium oxide, or the like), or the like. In this case, when the thermoplastic resin is used as the material of each of the sub-insulating materials 114, an influence of stress that may be generated in a warm forming process used at the time of manufacturing the coil component 100 may be reduced, and a forming density of the body 101 may be further improved.

Meanwhile, when a forming pressure is increased, shapes of the second magnetic particles 113 having the fine size may be changed, and hysteresis loss may be increased due to such a change in the shapes, such that magnetic permeability may be reduced. When the composites 115 are implemented by aggregating the plurality of second magnetic particles 113 as in the present exemplary embodiment, even though the forming pressure is increased, the change in the shapes of the second magnetic particles 113 may be reduced by the sub-insulating portions 114 existing between the second magnetic particles 113. In this case, when a material having a softening point of 50° C. or more is used as the material constituting each of the sub-insulating materials 114, generation of stress in the pressing and forming process may be significantly reduced.

A material of the main insulating portion 112 may also be the thermosetting resin, the thermoplastic resin, the wax based material, the inorganic material, or the like, described above. The same material as that of the sub-insulating portion 114, for example, the thermoplastic resin may be used as the material of the main insulating material 112. However, the main insulating portion 112 and the sub-insulating portion 114 are not always formed of the same material, but may also be formed of different materials according to another exemplary embodiment.

The inventors of the present disclosure compared forming densities with one another while changing a ratio between the first magnetic particles and the second magnetic particles. Table 1 represents comparison results among forming densities in cases of manufacturing bodies in ratios between particles according to Comparative Examples and Inventive Examples (at a forming pressure of 1.5 ton/cm$^2$), and as the forming density becomes high, filling efficiency of the magnetic particles may be improved, such that magnetic permeability characteristics, or the like, may be improved. Here, Comparative Examples may be structures in which the first magnetic particles and the second magnetic particles are mixed with each other at a time and are then formed, without forming the second magnetic particles in the composite structure described above. In addition, powder grains having an average particle diameter of about 20 μm were used as the first magnetic particles, and fine powder grains having average particle diameters of about 5 μm and about 1 μm were used as the second magnetic particles.

TABLE 1

| | Particle Ratio | | | |
|---|---|---|---|---|
| | First Magnetic Particle (~20 μm) | Second Magnetic Particle (~5 μm) | Second Magnetic Particle (~1 μm) | Forming Density (%) |
| Comparative Example 1 | 70% | 30% | 0% | 80% |
| Comparative Example 2 | 65% | 30% | 5% | 82% |
| Comparative Example 3 | 60% | 40% | 0% | 75% |
| Comparative Example 4 | 60% | 30% | 10% | 72% |
| Inventive Example 1 | 70% | 30% | 0% | 82% |
| Inventive Example 2 | 65% | 30% | 5% | 85% |
| Inventive Example 3 | 60% | 40% | 0% | 85% |
| Inventive Example 4 | 60% | 30% | 10% | 87% |
| Inventive Example 5 | 50% | 50% | 0% | 85% |
| Inventive Example 6 | 50% | 40% | 10% | 85% |

When viewing experiment results of Table 1, first, as seen in Comparative Example 2, when the fine second magnetic particles having an average particle diameter of about 1 μm are added, a forming density was slightly increased as compared to Comparative Example 1 in which the fine second magnetic particles are not included. However, as seen in results of Comparative Examples 3 and 4, when a content of powder grains having an average particle diameter of 5 μm or 1 μm in the second magnetic particles is increased, a forming density was reduced. The reason is that a specific surface area of particles is increased due to an increase in a percent in the fine magnetic particles, such that a binder such as a resin, or the like, runs short to reduce formability.

To the contrary, as seen in results of Inventive Examples, when the second magnetic particles are manufactured in the composite structure, a forming density was improved as compared to Comparative Examples. Particularly, as seen in results of Inventive Examples 3 and 4 in which a content of the second magnetic particles is high, even though a content of the fine powder grains is increased, a forming density was increased unlike Comparative Examples in which the forming density is reduced. In addition, as seen in Inventive Examples 5 and 6, even though a content of the fine powder grains is increased, a forming density was not significantly changed.

As set forth above, in the coil component according to the exemplary embodiment in the present disclosure, a content of the insulating portion for dispersing the fine magnetic particles may be significantly reduced in spite of using the fine magnetic particles. Therefore, the magnetic permeability and the DC bias characteristics of the coil component may be improved.

While exemplary embodiments have been shown and described above, it will be apparent to those skilled in the art that modifications and variations could be made without departing from the scope of the present invention as defined by the appended claims.

What is claimed is:

1. A coil component comprising:

a body having a coil part embedded therein; and an external electrode connected to the coil part, wherein the body contains a plurality of first magnetic particles and a plurality of second magnetic particles, the second magnetic particles being smaller than the first magnetic particles, the pluralities of first and second magnetic particles being dispersed in a main insulating portion of the body, the plurality of second magnetic particles are dispersed in each of a plurality of sub-insulating portions to constitute composites, and a volume percentage of the second magnetic particles in the composites is greater than 80% and less than or equal to 90%, the main insulating portion includes a material different from a material respectively included in the plurality of sub-insulating portions, and at least two of the composites have different external shapes from each other.

2. The coil component of claim 1, wherein at least some of the plurality of second magnetic particles in the composites are in contact with each other.

3. The coil component of claim 1, wherein each of the composites includes the plurality of second magnetic particles, and shapes of at least some of the composites are different from each other.

4. The coil component of claim 3, wherein the shapes of the at least some of the composites have a random form.

5. The coil component of claim 3, wherein numbers of second magnetic particles included in the composites have a random form.

6. The coil component of claim 3, wherein volume percentages of the second magnetic particles included in the composites have a random form.

7. The coil component of claim 3, wherein an interval between the plurality of second magnetic particles belonging to a same composite, among the composites, is smaller than an interval between the plurality of second magnetic particles belonging to different composites of the composites.

8. The coil component of claim 1, wherein each of the composites has an average diameter within a range of 1 μm to 20 μm.

9. The coil component of claim 1, wherein the first magnetic particle has an average particle diameter within a range of 5 μm to 20 μm.

10. The coil component of claim 1, wherein the second magnetic particle has an average particle diameter less than 5 μm.

11. The coil component of claim 1, wherein at least some of the plurality of second magnetic particles have different sizes.

12. The coil component of claim 11, wherein some of the plurality of second magnetic particles have an average particle diameter less than 1 μm.

13. The coil component of claim 1, wherein the main insulating portion includes a thermoplastic resin.

14. The coil component of claim 1, wherein each of the plurality of sub-insulating portions includes a thermoplastic resin.

15. The coil component of claim 1, wherein each of the plurality of sub-insulating portions is formed of a material having a softening point of 50° C. or more.

16. A coil component comprising:

a body having a coil part embedded therein; and an external electrode connected to the coil part, wherein the body contains a plurality of first magnetic particles and a plurality of second magnetic particles, the second magnetic particles being smaller than the first magnetic particles, the pluralities of first and second magnetic particles being dispersed in a main insulating portion of the body, the plurality of second magnetic particles are dispersed in each of a plurality of sub-insulating portions to constitute composites, and a volume percentage of the second magnetic particles in the composites is greater than 80% and less than or equal to 90%, the main insulating portion includes a material different from a material respectively included in the plurality of sub-insulating portions, and a portion of a first composite among the plurality of sub-insulating portions has a protruding shape and a portion of a second composite adjacent to the first composite has a dented shape corresponding to the protruding shape of the first composite.

* * * * *